US006425217B1

(12) United States Patent
Furukawa et al.

(10) Patent No.: US 6,425,217 B1
(45) Date of Patent: Jul. 30, 2002

(54) BUILDING DRAINAGE SYSTEM

(75) Inventors: Satohiro Furukawa, Yokohama; Nobuyuki Tsukagoshi, Tokyo, both of (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/549,701

(22) Filed: Apr. 14, 2000

(30) Foreign Application Priority Data

Apr. 14, 1999 (JP) ..... 11-107251

(51) Int. Cl.[7] ..... E04C 2/52
(52) U.S. Cl. ..... 52/220.8; 52/302.3; 285/125.1
(58) Field of Search ..... 52/220.8, 302.1, 52/302.3; 285/129.1, 129.2, 125.1

(56) References Cited

U.S. PATENT DOCUMENTS 2,202,147 A * 5/1940 Gerriets ..... 52/220.8
3,707,165 A * 12/1972 Stahl ..... 52/220.2
3,853,140 A * 12/1974 Gorman ..... 137/357
4,038,737 A * 8/1977 Bretone, Jr. ..... 285/56
4,073,018 A * 2/1978 Arrowood ..... 285/129.1
4,839,927 A * 6/1989 Watanabe ..... 4/211
4,860,503 A 8/1989 Palmer
5,076,310 A * 12/1991 Barenburg ..... 52/220.2

FOREIGN PATENT DOCUMENTS

FR 1 111 659 3/1956
FR 1 574 338 7/1969
FR 2 240 322 3/1975

* cited by examiner

*Primary Examiner*—Michael Safavi
(74) *Attorney, Agent, or Firm*—Sughrue Mion, PLLC

(57) ABSTRACT

A building drainage system including: a drainage stack passing through stories in the vertical direction; appliance drainage pipes connected to water-service terminal appliances on each of the stories; and a combined joint for connecting the appliance drainage pipes provided on each of the stories to the drainage stack. In this system, the combined joint for connecting the appliance drainage pipes provided on each of the stories to the drainage stack is at a level lower than that of a floor slab of the story, to sufficiently give a vertical velocity component to a fluid flowing in each of the appliance drainage pipes, thereby combining the fluid to a fluid flowing in the drainage stack.

18 Claims, 10 Drawing Sheets

BUILDING DRAINAGE SYSTEM

BACKGROUND OF THE INVENTION

The present invention principally relates to a new building drainage system.

A conventional building drainage system used for apartment houses, detached houses, etc. generally includes a drainage stack (hereinafter, referred to as "stack") passing through stories; appliance drainage pipes (hereinafter, referred to as "drainage pipes") connected to water-service terminal appliances such as a kitchen and a basin provided on each of the stories and extending while being tilted at a slight slope with respect to a floor slab of the story; and a combined joint (hereinafter, referred to as "joint") for connecting the drainage pipes on each story to the stack, the joint being provided on the same story; wherein waste water from the water-service terminal appliances on each story is discharged in the drainage pipes, being introduced to the joint provided on the same story, and is combined to a fluid flowing in the stack. At the joint of such a conventional drainage system, the drainage pipes cross the stack at an angle of 90° or slightly smaller than 90°, and therefore, the joint is required to have a large capacity, particularly, a large horizontal cross-section. As a result, there arise problems that the joint becomes heavy and expensive, and further becomes poor in the degree of freedom in design because the joint requires a wide space.

In other words, the vertical velocity component of a fluid flowing in each of the drainage pipes is significantly low, and accordingly, at the joint for connecting the drainage pipes to the stack, a cross-sectional occupancy of the fluid in the drainage pipes to a fluid in the stack becomes very large. As a result, a ventilation resistance caused when the fluid flowing in the drainage pipes is combined to the fluid flowing down in the stack becomes significantly large. For this reason, when combined with the fluid flowing down in the stack, the fluid flowing in the drainage pipes interferes with the fluid flowing in the stack, to increase the negative pressure in the stack, thereby causing breakage of sealing of a trap and abnormal noise.

A combined joint configured such that drainage pipes are connected to a stack while being tilted at a specific angle with respect to the stack has been disclosed; however, such a joint is intended to obliquely combine a fluid flowing in each drainage pipe to a fluid flowing in the stack. To be more specific, according to this joint, since the vertical velocity component of the fluid flowing in the drainage pipe is low, there arises the same problem as that described above.

Such a problem is basically due to the fact that the vertical velocity component of a fluid or waste water transversely flowing from appliances on each story is, at the combined joint provided at the same story, largely different from a vertical velocity of a fluid flowing down in the stack passing through the stories, to cause a negative pressure, thereby causing breakage of sealing of a trap and abnormal noise. To solve such a problem, the joint is required to be enlarged, resulting in the raised manufacturing cost. Also if there occurs breakage of sealing of a trap or the like, the sanitary function of the drainage system is lost. To avoid such an inconvenience, the maintenance for the drainage system must be frequently performed, which results in the raised maintenance cost.

A special drainage joint represented by a Solvent drainage system has been known. This joint is intended to make small the cause of generation of a negative pressure by largely expanding the horizontal cross-section of a combined portion and a connecting portion of a stack is offset. Such a joint, however, is large in size and weight, so that the manufacturing cost thereof is increased.

In general, according to the conventional building drainage system, waste water from a water-service terminal appliance is combined to that from another appliance at the same level, and is carried in a drain pipe with a slope in an open-channel manner, that is, in the state in which the drain pipe is not fully filled with the waste water. As a result, the drain pipe is required to be sufficiently thick and to have a standard slope, thereby causing a problem in giving a limitation to the degree of freedom in building plan.

According to the conventional building drainage system, even if there occurs clogging of a drain pipe or leakage of water from a deteriorated drain pipe, such a drain pipe cannot be repaired unless the interior of the building is partially broken, and the replacement of the drain pipe with a new drain pipe requires interruption of the use of the drain system and also requires a large cost. Further, according to the conventional building drainage system, since various kinds of waste water given to an environment by human activity are immediately combined to each other, there occurs a problem in which it is difficult to realize water-saving and make effective use of resources by recycle of heat and organic matters.

SUMMARY OF THE INVENTION

An object of the present invention is to provide a new building drainage system capable of improving the problem of the prior art system, particularly, reducing the so-called ventilation resistance by press-feeding a fluid in each drainage pipe under a siphon phenomenon, thereby allowing the fluid to flow in the drainage pipe in a full-channel manner, that is, in a state in which the drainage pipe is fully filled with the fluid.

To achieve the above object, according to the present invention, there Is provided a building drainage system including: a drainage stack passing through stories in the vertical direction; appliance drainage pipes connected to water-service terminal appliances on each of the stories, each of the appliance drainage pipes including a transversely extending portion and a downwardly extending portion; and a combined joint for connecting the appliance drainage pipes provided on each of the stories to the drainage stack; wherein the combined joint for connecting the appliance drainage pipes provided on each of the stories to the drainage stack is at a level lower than that of a floor slab of the story, to sufficiently give a vertical velocity component to a fluid flowing in each of the appliance drainage pipes, thereby combining the fluid to a fluid flowing in the drainage stack.

Preferably, each of the appliance drain pipes has a transversely extending portion and a downwardly extending portion, and the combined joint is disposed at a level lower than that of the transversely extending portion of the appliance drain pipe by a specific distance. The specific distance may be in a range of 100 cm or more, preferably, 200 cm or more; or may be equivalent to the vertical length of one story of an apartment house or the like.

Preferably, each of the appliance drainage pipes is connected to the combined joint while being tilted at a specific angle with respect to the vertical line. The specific angle may be in a range of less than 45° preferably, less than 30°, more preferably, less than 15°. Most preferably, each of the appliance drainage pipes is vertically connected to the combined joint.

The appliance drainage pipes may be singly connected to the combined joint. Also, the appliance drainage pipes may have the same diameter. Further, each of the appliance drainage pipes may be a flexible resin pipe.

The transversely extending portions of the appliance drainage pipes on each of the stories are placed on the floor slab of the story with no slope. Further, a portion, to be connected to the drainage stack, of each of the appliance drainage pipes may be provided with a counter-flow preventive valve having a flow control function.

According to the building drainage system having the above configuration, various kinds of waste water from water-service terminal appliances are discharged to the independent drainage pipes each having the transversely extending portion and the downwardly extending portion, being increased in vertical velocity component during a period of flowing down in the downwardly extending portions of the drainage pipes, and are combined to a fluid flowing in the stack. Accordingly, it is possible to significantly reduce the so-called ventilation resistance, and hence to make a negative pressure in the stack significantly smaller than that in the conventional building drainage system. Further, since the fluid flows in the drainage pipe in a full-channel manner under the siphon phenomenon, it is possible to make thin the diameter of the drainage pipe, and to eliminate the need of sloping the drainage pipe toward the stack. Even in the case of using a drainage pipe with a slight inverse-slope, the drainage can be sufficiently performed.

The present invention will be more concretely described below. The flexible pipes (drainage pipes) singly connected to appliances on each story are arranged such that the transversely extending portions of the pipes are placed on the floor slab of the story and the downwardly extending portions of the pipes are connected to the joint disposed at a level lower than that of the story. That is to say, the flexible pipe extends in the horizontal direction until it reaches the stack, being bent therefrom, and extends in the vertical direction, so that the fluid flows in the flexible pipe in a full-channel manner at a high velocity, and is combined to the fluid in the stack. To be more specific, the vertical velocity component of the fluid in the flexible pipe becomes at least 100 times that of the fluid flowing in the conventional drainage pipe, and a ratio of the vertical velocity component of the fluid in the flexible pipe to the final vertical velocity component of the fluid in the stack becomes about 0.3 to 0.5. Accordingly, as compared with the vertical velocity component of the fluid flowing in the drainage pipe (with a slope of 1/1000) of the conventional building drainage system, the cross-sectional occupancy of the fluid in the drainage pipe to the fluid in the stack becomes smaller, so that the ventilation resistance at the combined joint is significantly reduced by combination of the effect of reducing the flow rate of waste water by use of the drainage pipe having a small diameter, to suppress occurrence of a negative pressure in the stack, thereby improving the conventional building drainage system.

Assuming that the allowable flow rate of a fluid in the stack is nearly constant, the size of the joint of the present invention can be made smaller than that of the conventional joint. This allows the compact design of the drainage system. On the contrary, if the size of the joint of the present invention is designed to be identical to that of the conventional joint, it is possible to obtain a large allowable flow rate of the fluid in the stack.

Since the drainage pipes are basically configured as independent flexible pipes, the capacity of each drainage pipe is not required to be made large. For example, the drainage pipe may be configured as the polybutene pipe having a diameter of 20 mm. Further, since these pipes identical to each other in material and size are connected to respective appliances, it is possible to simplify the works of mounting the pipes.

Since the diameter of the drainage pipe of the present invention is reduced, the flow rate of waste water in the drainage pipe becomes about ½ to ¼ the flow rate of waste water flowing in the conventional drainage pipe. Further, since the vertical velocity component of the waste water flowing in the downwardly extending portion of the drainage pipe is increased to a value of about 2–2.5 m/sec, the waste water is combined to a fluid in the stack at a high velocity. Accordingly, it is possible to suppress the increase in ventilation resistance at the joint and relieve a negative pressure in the stack even in the case of using the joint having a small capacity.

The conventional drainage system has the following problem: namely, when the drainage of waste water flowing in a drainage pipe connected to an appliance in a full-channel manner is completed, air is strongly sucked from the drainage port of the appliance through the drainage pipe by a siphon suction force; and such air interferes with the waste water remaining in the drainage pipe, to cause large suction noise. The building drainage system of the present invention is also improved to solve the problem associated with noise caused by suction of air upon drainage.

In this way, according to the present invention, since the drainage pipes from appliances are independent from each other, it is possible to increase the degree of freedom in design upon enlargement or repair of the building. Also, by use of the drainage pipes having the same diameter, it is possible to simplify the works of mounting the drainage pipes. Further, the transversely extending portion of the drainage pipe can be arranged to extend toward the stack with no slope.

The leading end, to be combined to the stack, of the drainage pipe is preferably provided with a valve having both a flow control function and a counter-flow preventive function. For example, the valve may be configured to be opened at a water pressure of 2 mAq and to be closed after completion of drainage. The use of such a valve allows a cyclic siphon drainage of waste water in the drainage pipe, which enables the automatic cleaning of the inside of the drainage pipe.

To be more specific, upon completion of drainage of waste water in the drainage pipe at a water-filling ratio near the full-filling ratio or upon induction of the siphon phenomenon by washing-and-draining, if the amount of waste water is small, atmospheric air is sucked from the drainage port of the appliance and thereby the flow of the waste water is temporarily stopped. At this time, there occurs large drainage noise. To prevent occurrence of such noise, it may be desirable to provide a drainage valve having a flow control function capable of adjusting the siphon suction force, and automatically changing the opening degree in proportional to the magnitude of a static pressure generated by the fluid in the drainage pipe.

The drainage pipes basically, singly extend to the combined joint, and in some cases, the drainage pipes may be bundled before being connected to the joint. These drainage pipes are generally directed around the stack, and in some cases, the drainage pipes can be collected and housed in a ventilation stack passing through an apartment house in the vertical direction.

A polybutene pipe can be widely adopted as the flexible resin pipe as the drainage pipe. A method of connecting the polybutene pipe to the joint with a single-motion has been developed. For the drainage system of the present invention, it may be desirable to adopt such a connection method for connecting the polybutene pipe to the joint.

DESCRIPTION OF THE PREFERRED EMBODIMENTS

Hereinafter, a building drainage system of the present invention will be described in detail with reference to the accompanying drawings.

Figure 1:
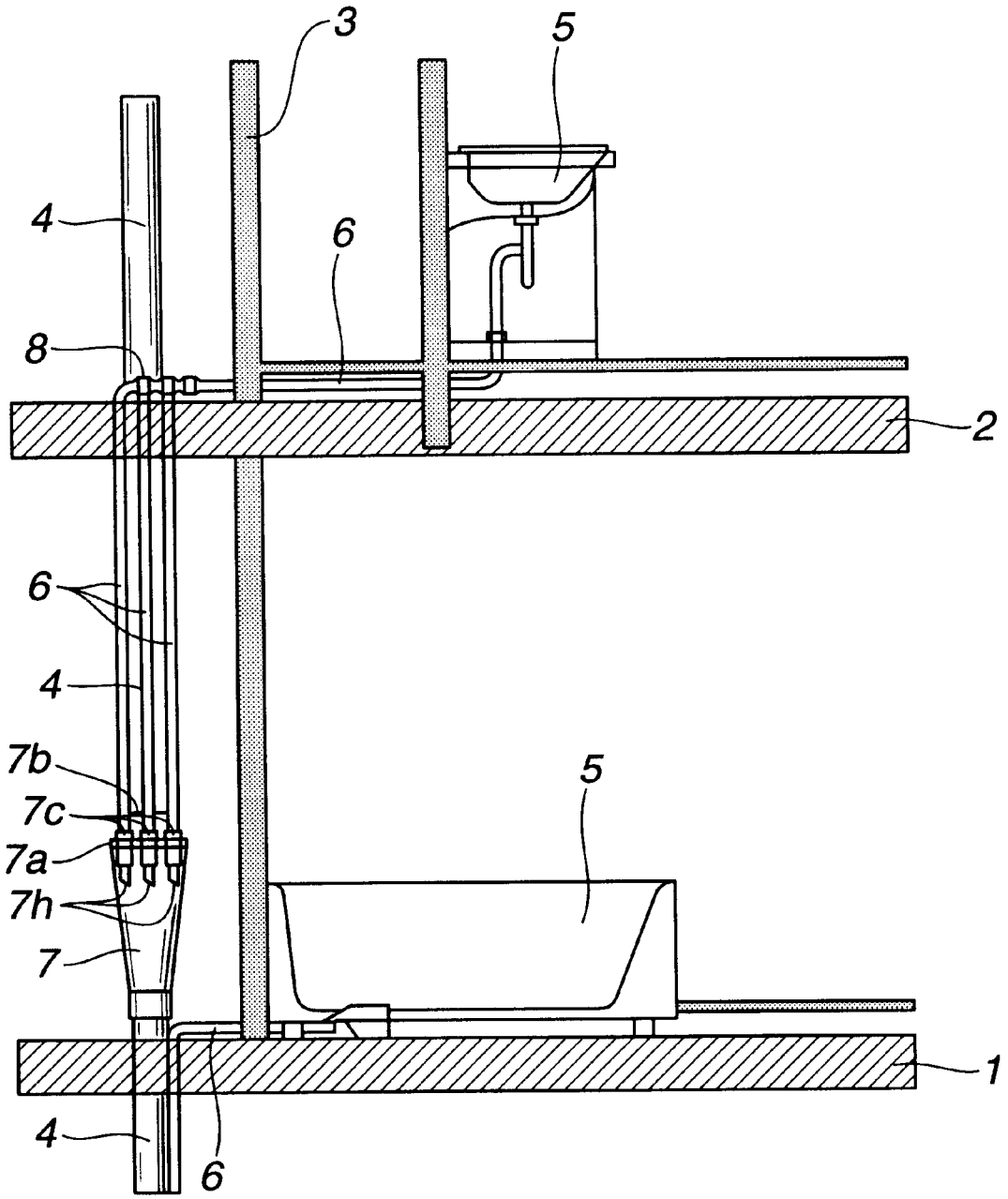
FIG. 1 is a view showing the entire structure of a building drainage system according to the present invention.

FIG. 1 is a view showing the entire structure of a building drainage system of the present invention. In the figure, reference numerals 1 and 2 designate floor slabs on a certain story and a story positioned directly thereover, and 3 designates a pipe shaft wall. A stack 4 having a diameter of 100 mm is provided in such a manner as to pass through these stories, and drainage pipes 6 connected to water-service terminal appliances 5 are connected to the stack 4. In the figure, the appliance 5 on the upper story is represented by a basin 5, and the drainage pipe 6 configured as a polybutene pipe 6 having a diameter of 20 mm is connected to the basin 5. The polybutene pipes are of course connected to other appliances (not shown). The polybutene pipe 6 extends on the floor slab 2 in the transverse direction with no slope until it reaches the stack 4, being curved downwardly therefrom, and is connected to the stack 4 at a joint 7.

The bent portion of the polybutene pipe 6 may be formed by bending the pipe 6; however, a bent pipe 8 may be used as the bent portion. To be more specific, the bent pipe 8 may be connected between two straight pipes, to form the polybutene pipe 6 having the bent portion. In the example shown in FIG. 1, the joint 7 is disposed near the lower floor slab 1. The joint 7 is formed into an inverse-triangular shape in cross-section extended upwardly toward the stack 4, and the leading ends of the stack 4 and the polybutene pipes 6 are connected to an extension plane 7*a* (diameter: 150 mm) of the joint 7. To be more specific, the extension plane 7*a* has a connection port 7*b* to be connected to the stack 4, and a plurality of vertical holes 7*c*. In particular, push-locks to be described later are mounted in the vertical holes 7*c*, and the leading ends of the polybutene pipes 6 are connected thereto.

In the example shown in FIG. 1, the difference in height between the floor slab 2 and the joint 7 is set at 2.5 m. The fluid or waste water in the stack 4 is dropped while being accelerated in the vertical direction (with a nearly constant flow rate). Meanwhile, the fluid or waste water from each of the appliances on each story flows in the transversely extending portion of the polybutene pipe 6 placed on the floor slab 2, and dropped in the downwardly extending portion of the polybutene pipe 6 while being increased in vertical velocity component due to the difference in height (2.5 m) between the floor slab 2 and the joint 7. In this way, the waste water in the polybutene pipe 6 is naturally combined to the waste water in the stack 4 at the joint 7. In the figure, reference numeral 7*h* designates a valve provided at the leading end of the drainage pipe 6. The valve 7*h* has a counter-flow preventive function and/or a flow control function.

Figure 2:
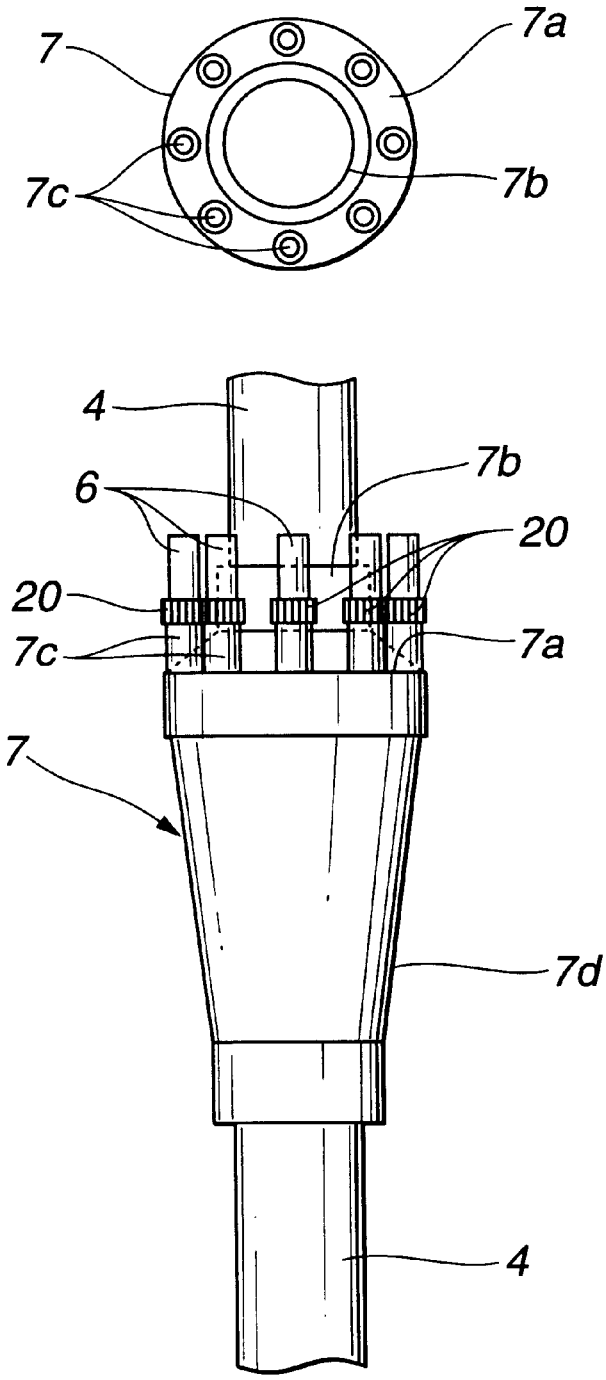
FIG. 2 is a side view showing a first example of a joint according to the present invention.

FIG. 2 is a view showing a first example of the joint 7 of the building drainage system according to the present invention. The joint 7 is configured as a hard synthetic resin joint sized such that the outside diameter is 150 mm, the diameter of a stack connection port 7*b* is 100 mm, and the length is 400 mm. The joint 7 is formed into an inverse-triangular shape in cross-section in which eight vertical holes 7*c* are-formed around the connection port 7*b*. The polybutene pipes 6 are connected to the vertical holes 7*c*. A fluid flowing from the polybutene pipes 6 in the joint 7 is restricted in a space (restriction portion) 7*d* formed into an inverse-triangular shape in cross-section, to be thus naturally combined to a fluid flowing from the stack 4 in the joint 7.

To be more specific, the fluid flowing down in the stack 4 is uniformly, vertically dropped in the central portion of the joint 7, while the fluid vertically accelerated in the polybutene pipes 6 connected to the vertical holes 7*c* is dropped in the joint 7. Then, the fluid from the polybutene pipes 6 are combined to the fluid from the stack 4 at the restriction portion 7*d* formed into the inverse-triangular shape, and the fluids thus combined flow in the stack 4 connected to the lower end of the joint 7. In this way, the fluid in the polybutene pipes 6 accelerated in the vertical direction is relatively easily combined to the fluid in the stack 4, so that a negative pressure occurs in the joint 7, to cause an effect of further sucking the fluid from the polybutene pipes 6.

In addition, a flap valve made from a thin rubber (not shown) may be provided on the leading end of the polybutene pipe 6, to prevent occurrence of counter-flow on the polybutene pipe 6 side.

If a resin pipe is used as the stack 4, only a portion, passing through a fire protection partition wall, of the stack 4 may be covered with a metal sheath pipe.

Figure 3:
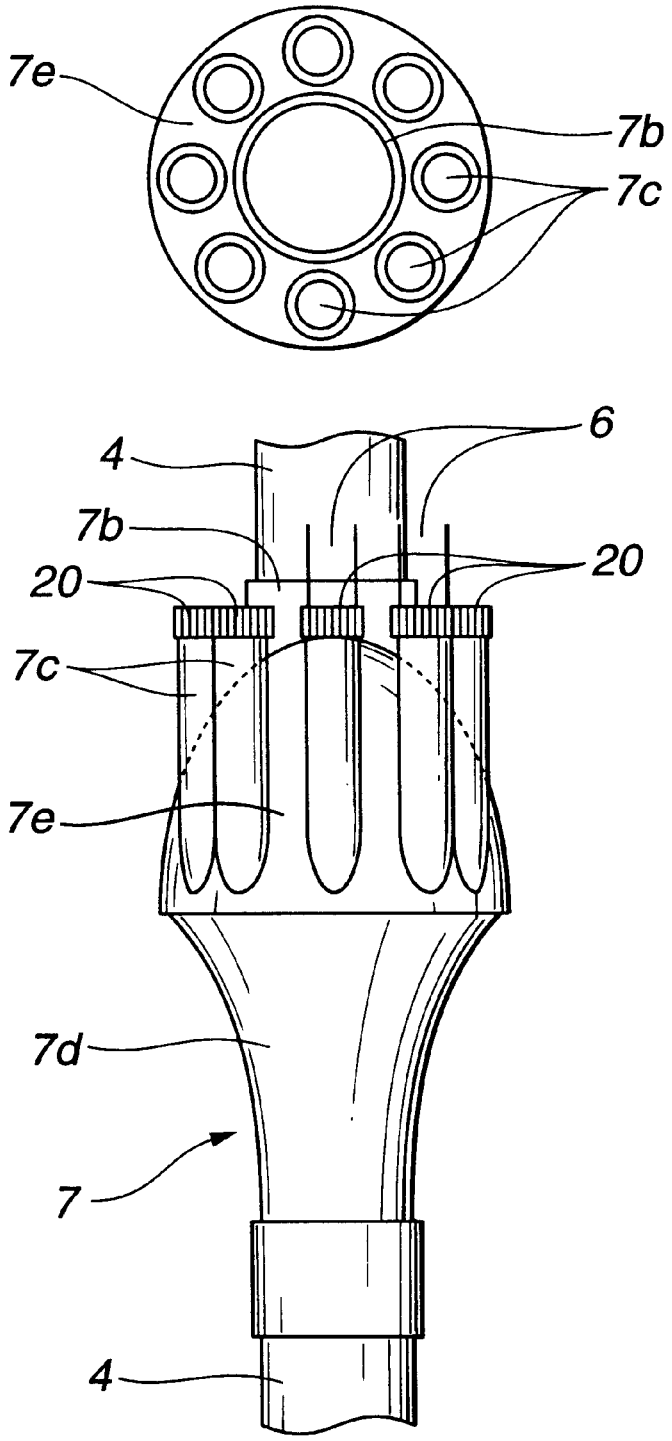
FIG. 3 is a side view showing a second example of a joint according to the present invention.

FIG. 3 is a view showing a second example of the joint 7 of the building drainage system according to the present invention. The joint 7 is configured as a hard synthetic resin joint sized such that the outside diameter is 200 mm, the diameter of a stack connection port 7*b* is 100 mm, and the length is 400 mm. The joint 7 has a curvedly expanded portion 7*e* disposed on the upper side and a restriction portion 7*d* recessed inwardly disposed on the lower side. The stack 4 is vertically connected to the centers of the curvedly expanded portion 72 and the restriction portion 7*d*. Eight vertical holes 7*c* are formed in the outer peripheral portion of the curvedly expanded portion 7*e*, and the polybutene pipes 6 are connected to the vertical holes 7*c*.

A fluid vertically accelerated flows from the polybutene pipes 6 connected to the vertical holes 7*c* in the joint 7, being combined to a fluid in the stack 4 at the restriction portion 7*d* of the joint 7, and easily enters in the stack 4 connected to the lower end of the joint 7. Accordingly, a negative pressure occurs in the joint 7, to cause an effect of further sucking the fluid on the polybutene pipe 6 side.

Figure 4:
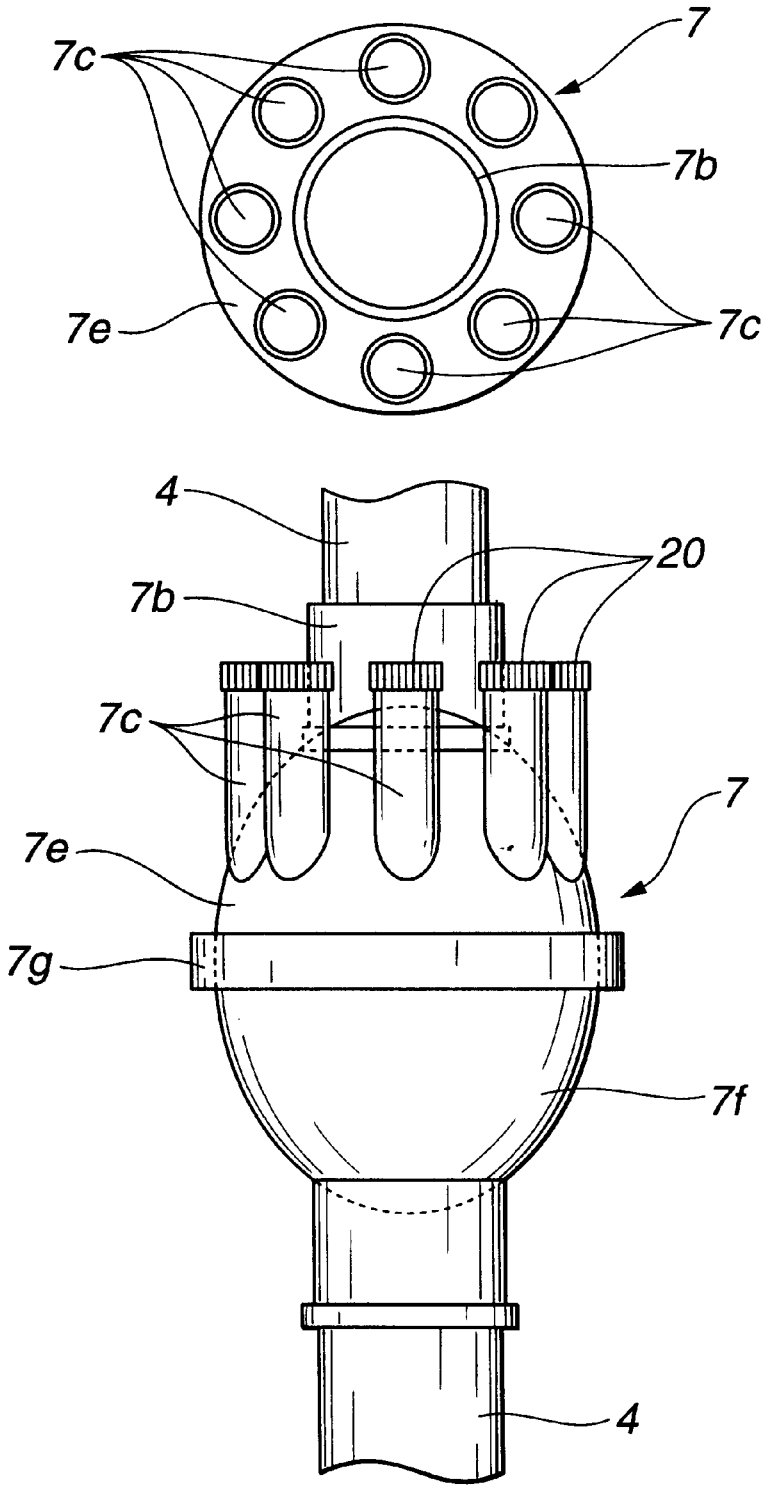
FIG. 4 is a side view showing a third example of a joint according to the present invention.

FIG. 4 is a view showing a third example of the joint 7 of the building drainage system according to the present invention. This joint 7 has a curvedly expanded portion 7*e* disposed on the upper side, and a curvedly expanded portion 7*f* disposed on the lower side in such a manner as to be symmetrical to the curvedly expanded portion 7*e* . Both the expanded portions 7*e* and 7*f* are connected to each other via a coupling joint 7*g*. Such a joint 7 has a desirable pressure-proof structure.

Figure 5:
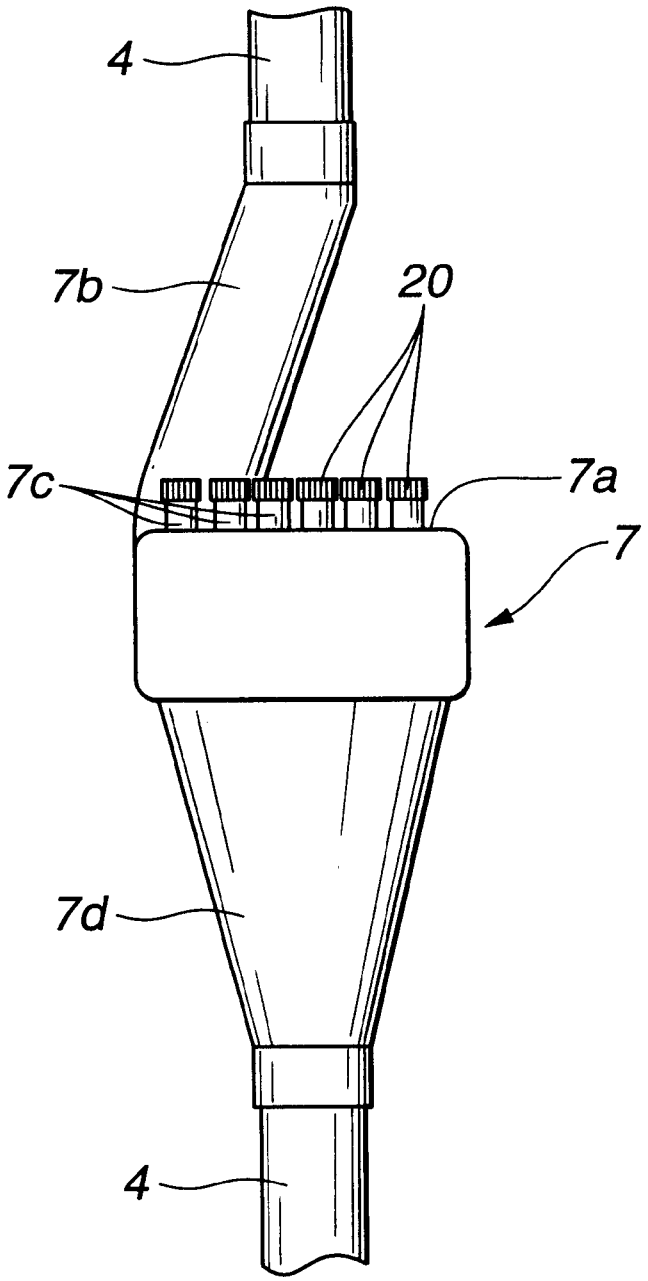
FIG. 5 is a side view showing a fourth example of a joint according to the present invention.

FIG. 5 is a view showing a fourth example of the joint 7 of the building drainage system according to the present invention. The joint 7 is formed into an inverse truncated cone in which the upper end has a diameter of 200 mm and the lower end has a diameter of 100 mm. A plurality of vertical holes 7*c* for supporting the polybutene pipes 6 are collectively disposed on one side of the upper end portion, and the stack 4 is disposed at a position offset from the vertical holes 7*c*. Even in this joint 7, a combined space is formed by a restriction portion 7*d* whose diameter becomes smaller toward the lower side.

As a result of experiments, it becomes apparent that the offset of the stack 4 exhibits a merit of reducing the ventilation resistance formed in the combined portion, to relieve a variation in maximum pressure in a portion of the stack 4 near the story directly under the combined portion, thereby making large the allowable flow rate of the stack 4.

Figure 6:
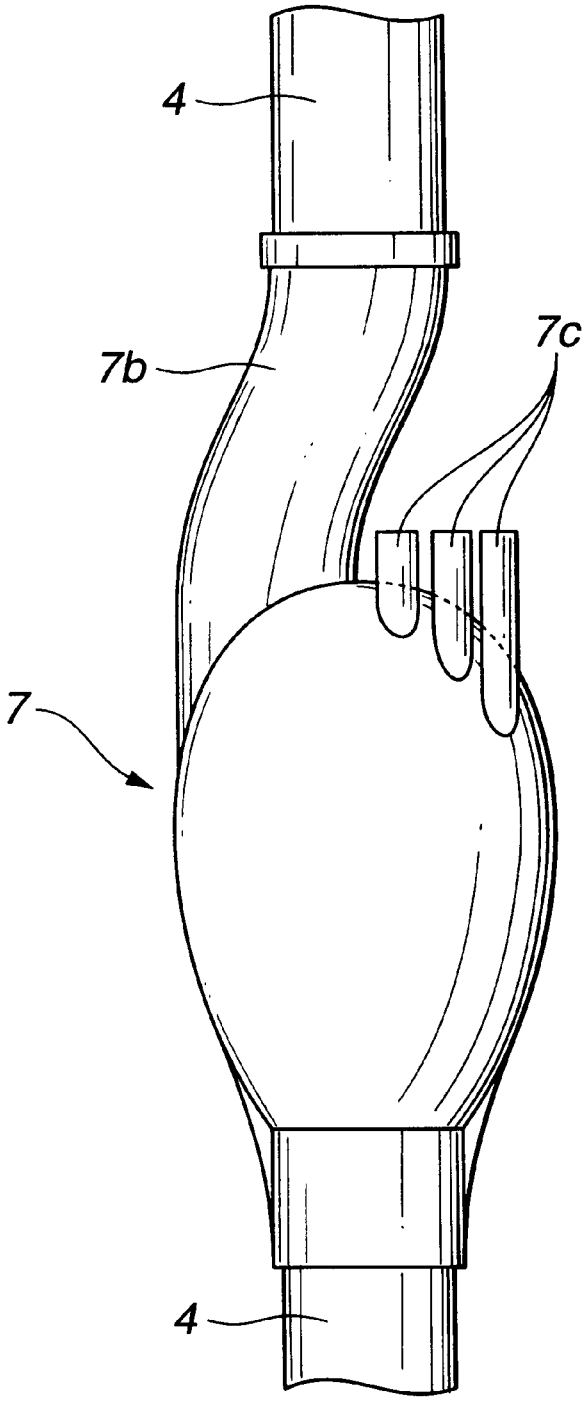
FIG. 6 is a side view showing a fifth example of a joint according to the present invention.

FIG. 6 is a view showing a fifth example of the joint 7 of the building drainage system according to the present invention. The joint 7 is formed into an elongated shape with its central portion expanded. A stack connection port 7*b* connected to the upper stack 4 is connected to the joint 7 while being offset on one side (left side, in the figure) of the joint 7, and correspondingly a plurality of vertical holes 7*c* are offset on the stack 4 side (on the right side, in the figure). With this configuration, a fluid in the polybutene pipes 6 can be easily combined to a fluid in the stack 4.

Figure 7:
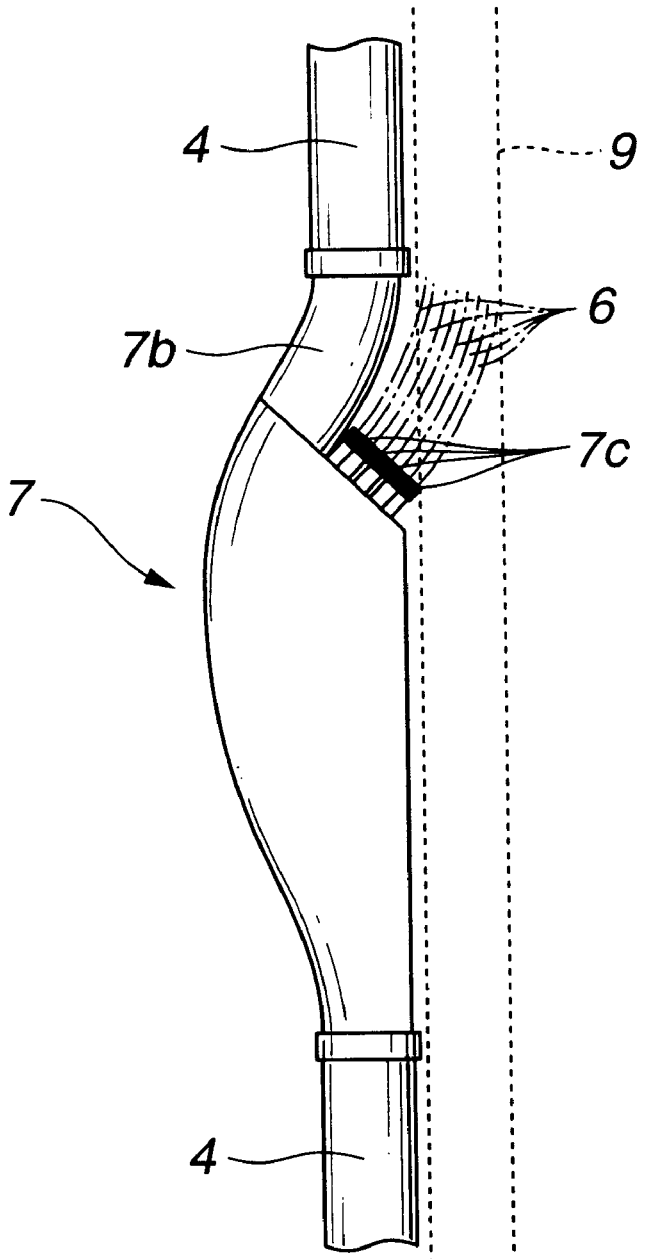
FIG. 7 is a side view showing a sixth example of a joint according to the present invention.

FIG. 7 is a view showing a sixth example of the joint 7 of the building drainage system according to the present invention. A stack connection port 7*b* connected to the upper stack 4 is connected to the joint 7 while being offset on one side (left side, in the figure) of the joint 7, and a plurality of vertical holes 7*c* are disposed while being tilted at 45° with respect to the stack connection port 7*b*. The polybutene pipes 6 are connected to the vertical holes 7*c*. In this case, the polybutene pipes 6 are bundled in a ventilation pipe 9 and are inserted from above. A fluid from the stack 4 flows down along the side surface of the joint 7 into the joint 7, and a fluid from the polybutene pipes 6 flows toward the fluid from the stack 4 in the joint 7. Then, the fluids thus combined flow in the lower stack 4.

Figure 8:
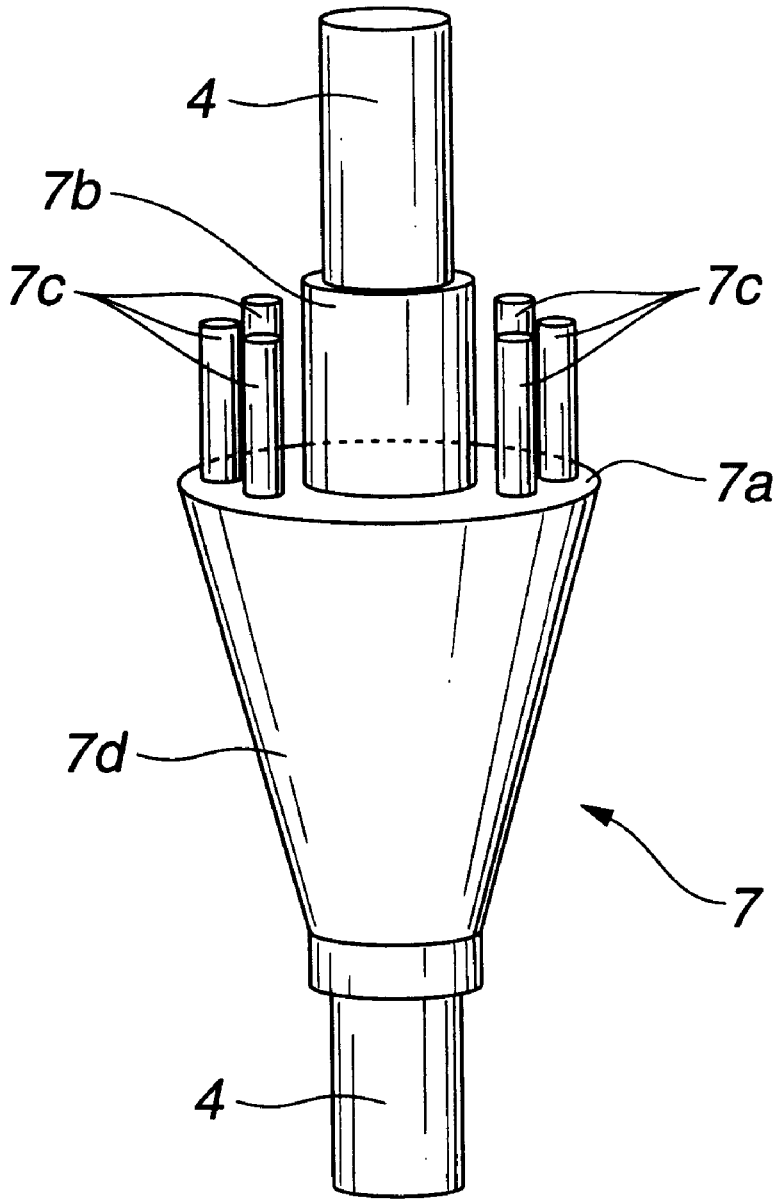
FIG. 8 is a side view showing a seventh example of a joint according to the present invention.

According to the present invention, the vertical holes 7*c* can be freely disposed around the stack 4. For example, as shown in FIG. 8, the vertical holes 7*c* can be disposed while being divided on the right and left sides. In this case, the structure of the joint 7 can be flattened and is usable in the narrow space.

Figure 9:
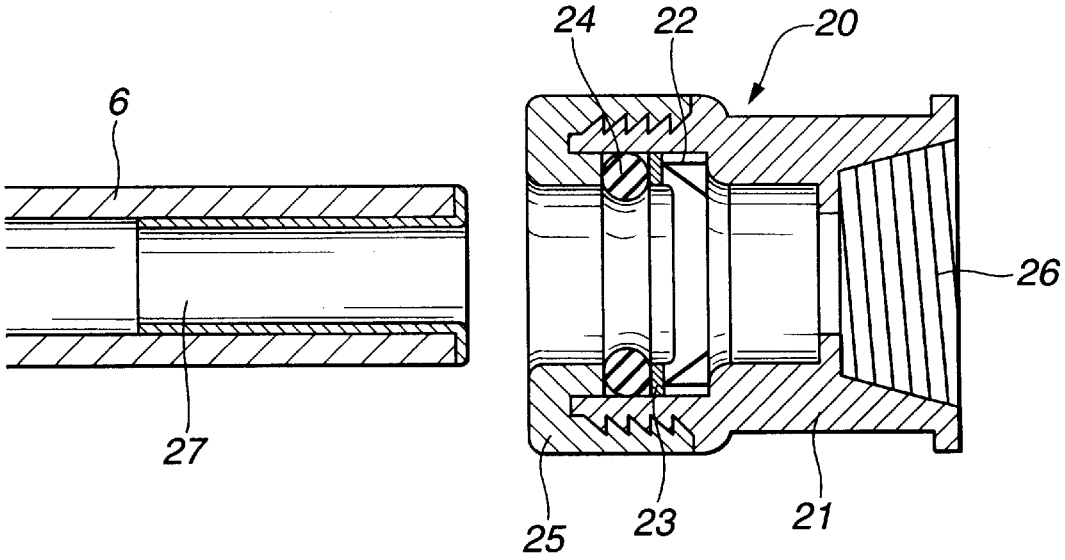
FIG. 9 is a sectional view of the entire configuration of a push-lock.
Figure 10:
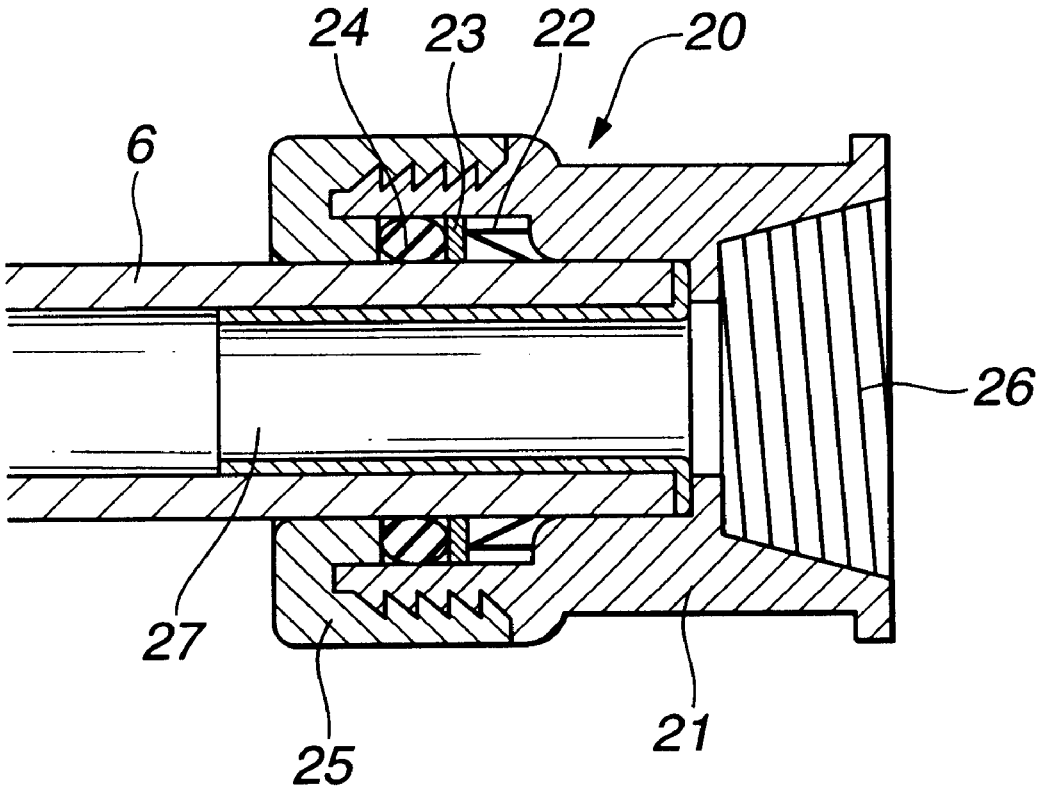
FIG. 10 is a sectional view showing the entire configuration of the push-lock in which a polybutene pipe is mounted.

FIGS. 9 and 10 are views each showing one example of a push-lock 20 connectable with a single motion, which is used for connection of the drainage pipe 6 of the present invention, wherein FIG. 9 is a sectional view showing a state before the polybutene pipe 6 is mounted in the push-lock 20, and FIG. 10 is a sectional view showing a state after the polybutene pipe 6 is mounted in the push-lock.

A grab ring 22, a washer 23, and an O-ring 24 are mounted in a socket 21 of the push-lock 20, and a cap 25 for supporting the grab ring 22, washer 23 and O-ring 24 is screwed in the socket 21. The socket 21 has a female thread portion 26 to be screwed with the vertical hole 7*c* of the joint 7, or the water-service terminal appliance 5 or bent pipe 8.

A collar 27 is fitted in the leading end of the polybutene pipe 6, and the polybutene pipe 6 is inserted in the cap 25. At this time, the grab ring 22 bites the outer surface of the polybutene pipe 6, to mount the polybutene pipe 6 in the push lock 20. In this way, the polybutene pipe 6 is certainly, simply mounted in the push-lock 20.

The feature of the present invention, in which the drainage pipes are reduced in diameter and unified for each appliance, can be combined with an already available cold water/hot water supply system into a sheath pipe-header system which is expected as an advanced water piping system as a whole. Such a water piping system is advantageous in exhibiting a resistance against high-temperature and corrosion, and in eliminating a skilled technique for mounting the pipes because the pipes can be laid out with no slope, thereby significantly reducing the burden of a worker. Further, it is possible to shorten the working time without the need of any large-sized tool and the like, to make small the size and weight of each of parts adopted for the entire building drainage system, to easily replace the parts with new ones, and to improve the productivity and reliability at the building site and also reduce the cost. The building drainage system of the present invention, therefore, is expected as a future global, generalized building drainage system.

Since waste water is drained in the stack for each appliance, it is possible not only to obtain a merit in terms of construction of a building and maintenance and management of the building, but also to perform the separation and collection of various kinds of waste water by using the stacks for each application and hence to realize the reuse of waste water and the recovery of heat and organic matters. This makes it possible to effectively use a small-and-medium sized facility capable of realizing water-saving and recovery of head and organic matter for each group of houses or each housing complex, and hence to contribute to the future global environmental problem.

While the preferred embodiments of the present invention have been described using the specific terms, such description is for illustrative purposes only, and it is to be understood that changes and variations may be made without departing from the sprit or scope of the following claims.

What is claimed is:

1. A building drainage system comprising:

a drainage stack passing through stories in the vertical direction;

appliance drainage pipes connected to water-service terminal appliance on each of said stories, each of said appliance drainage pipes including a transversely extending portion and a downwardly extending portion; and a combined joint for connecting said appliance drainage pipes provided on each of said stories to said drainage stack;

wherein said combined joint for connecting said appliance drainage pipes provided on each of said stories to said drainage stack is at a level lower than that of a floor slab of said story, to sufficiently give a vertical velocity component to a fluid flowing in each of said appliance drainage pipes, thereby combining said fluid to a fluid flowing in said drainage stack, and said combined joint is disposed at a level lower than that of said transversely extending portion of said appliance drain pipe by a specific distance.

2. A building drainage system according to claim 1, wherein said specific distance is in a range of 100 cm or more.

3. A building drainage system according to claim 1, wherein said specific distance is in a range of 200 cm or more.

4. A building system according to claim 1, wherein said specific distance is equivalent to the vertical length of one story.

5. A building drainage system according to claim 1, wherein each of said appliance drainage pipes is connected to said combined joint while being tilted at a specific angle with respect to the vertical line.

6. A building drainage system according to claim 5, wherein said specific angle is in a range of less than 45°.

7. A building drainage system according to claim 5, wherein said specific angle is in a range of less than 30°.

8. A building drainage system according to claim 5, wherein said specific angle is in a range of less than 15°.

9. A building drainage system according to claim 5, wherein each of said appliance drainage pipes is vertically connected to said combined joint.

10. A building drainage system according to claim 1, wherein said appliance drainage pipes are singly connected to said combined joint.

11. A building drainage system according to claim 1, wherein said appliance drainage pipes have the same diameter.

12. A building drainage system according to claim 1, wherein each of said appliance drainage pipes is a flexible resin pipe.

13. A building drainage system according to claim 1, wherein said appliance drainage pipes on each of said stories are placed on said floor slab of said story with no slope.

14. A building drainage system according to claim 1, wherein a portion of each of said appliance drainage pipes is provided with a counter-flow preventive valve.

15. A building drainage system according to claim 1, wherein a portion of each of said appliance drainage pipes is provided with a flow control valve.

16. A building drainage system comprising:

a drainage stack passing through stories in the vertical direction;

appliance drainage pipes connected to water-service terminal appliances on each of said stories, each of said appliance drainage pipes including a transversely extending portion and a downwardly extending portion; and a combined joint for connecting said appliance drainage pipes provided on each of said stories to said drainage stack;

wherein said combined joint for connecting said appliance drainage pipes provided on each of said stories to said drainage stack is at a level lower than that of a floor slab of said story, to sufficiently give a vertical velocity component to a fluid flowing in each of said appliance drainage pipes, thereby combining said fluid to a fluid flowing in said drainage stack, and said appliance drainage pipes on each of said stories are placed on said floor slab of said story with no slope.

17. A building drainage system according to claim 16, wherein a portion of each of said appliance drainage pipes is provided with a counter-flow preventive valve.

18. A building drainage system according to claim 16, wherein a portion of each said appliance drainage pipes is provided with a flow control valve.

* * * * *